United States Patent [19]

Miki

[11] Patent Number: 4,655,678

[45] Date of Patent: Apr. 7, 1987

[54] COMBINED TURBO-MOLECULAR PUMP

[75] Inventor: Masaharu Miki, Narashino, Japan

[73] Assignee: Seiko Seiki Kabushiki Kaisha, Japan

[21] Appl. No.: 704,384

[22] Filed: Feb. 22, 1985

[30] Foreign Application Priority Data

Feb. 24, 1984 [JP] Japan ..... 59-25390[U]

[51] Int. Cl.[4] ..... F04D 19/04

[52] U.S. Cl. ..... 415/71; 415/90

[58] Field of Search ..... 415/71, 90, 199.2, 199.3, 415/199.5

[56] References Cited

U.S. PATENT DOCUMENTS

| | | | |
|---|---|---|---|
| 1,586,160 | 5/1926 | Mavron et al. | 415/71 X |
| 1,975,568 | 10/1934 | Dubrovin | 415/71 |
| 2,954,157 | 9/1960 | Eckberg | 415/71 X |

FOREIGN PATENT DOCUMENTS

| | | | |
|---|---|---|---|
| 291268 | 11/1913 | Fed. Rep. of Germany | 415/90 |
| 47-33447 | 8/1972 | Japan | 415/90 |

*Primary Examiner*—Robert E. Garrett
*Assistant Examiner*—Joseph M. Pitko
*Attorney, Agent, or Firm*—Robert E. Burns; Emmanuel J. Lobato; Bruce L. Adams

[57] ABSTRACT

A turbo-molecular pump has a housing containing a plurality of stationary plates which are alternately arranged with respect to a plurality of rotary plates connected to a rotationally driven rotor. Spiral flow grooves all having the same winding direction are formed on opposite sides of the stationary plates, and gas drawn through an inlet port of the housing flows downwardly through a plurality of axial passages formed in the stationary plates and then radially inwardly into the spiral flow grooves wherein the gas is compressed. Axial grooves in the rotor transport the compressed gas from the spiral flow grooves to a helical groove at the lower part of the housing which further compresses the gas and discharges the same through an outlet port.

13 Claims, 4 Drawing Figures

COMBINED TURBO-MOLECULAR PUMP

BACKGROUND OF THE INVENTION

The present invention relates to improvements in combined turbo-molecular pumps.

As a prior art type of a turbo-molecular pump, there is described in Japanese patent publication No. 47-33446, a turbo-molecular pump whose outlet port is coaxially disposed with a thread-type pump.

The turbo-molecular pump of this type has the advantages that relatively low of the pumping speed, which is a drawback of the thread-type pump, is improved and its processing is simplified by utilizing the higher pumping speed that is a characteristic of the turbo-molecular pump and by providing fully compressed gas which is supplied from the inlet port to the thread-type pump.

However, this type of turbo-molecular pump can be operated at a high compression ratio and at a throughput which corresponds to the throughput of the thread-type pump when the turbo-molecular pump is operated in a high vacuum range, but in the range of $10^{-2}$ to 1 Torr, the efficiency of the turbo-molecular pump is normally extremely reduced so that the compression ratio thereof can not be improved. Thus, as shown in FIG. 1, the diminished throughput, which is a disadvantage of the thread-type pump, becomes apparent when operating in the range $10^{-2}$ to 1 Torr so that the pumping speed is rapidly reduced. Moreover, in this vacuum range, the efficiency of the rotary type pump is also at a low level. In another prior art type of turbo-molecular pump as described in Japanese patent publication No. 47-33447, alternately arranged rotary circular plates and stationary circular plates having an upper and a lower reverse spiral thereon are employed in place of the thread-type pump. But, even in this pump, as in the thread-type pump, the gas flow passage extends from the inlet side toward the outlet side along the winding direction of the spiral so that as in the thread-type pump, the pumping speed is extremely reduced in the range in which the compression ratio of the turbo-molecular pump is reduced.

SUMMARY OF THE INVENTION

An object of the present invention is to improve the pumping speed in the range of $10^{-2}$ to 1 Torr. That is, the range of $10^{-2}$ to 1 Torr is a vacuum range which is suitable for fabricating semiconductors by flowing low-pressurized gas of plasma CVD and reactive ion-etching material and so on. This invention provides a combined turbo-molecular pump which is suitable for use in this vacuum range.

To accomplish the foregoing objects, the combined turbo-molecular pump according to the present invention includes rotary circular plates at the inlet port of a rotatable rotor and stationary circular plates being alternatively arranged in layers at the circumference thereof, and a helical or thread groove is disposed either on the rotor or the cylindrical part which surrounds the rotor in the vicinity of the circumference of the outlet side of the rotor. On both surfaces of either the rotary circular plates or the stationary circular plates, there is provided respectively a spiral groove having the same winding direction, and the circumference of each stationary circular plate communicates with the inlet port and the rotary circular plates communicate with the helical or thread groove.

DESCRIPTION OF THE INVENTION

Figure 2:
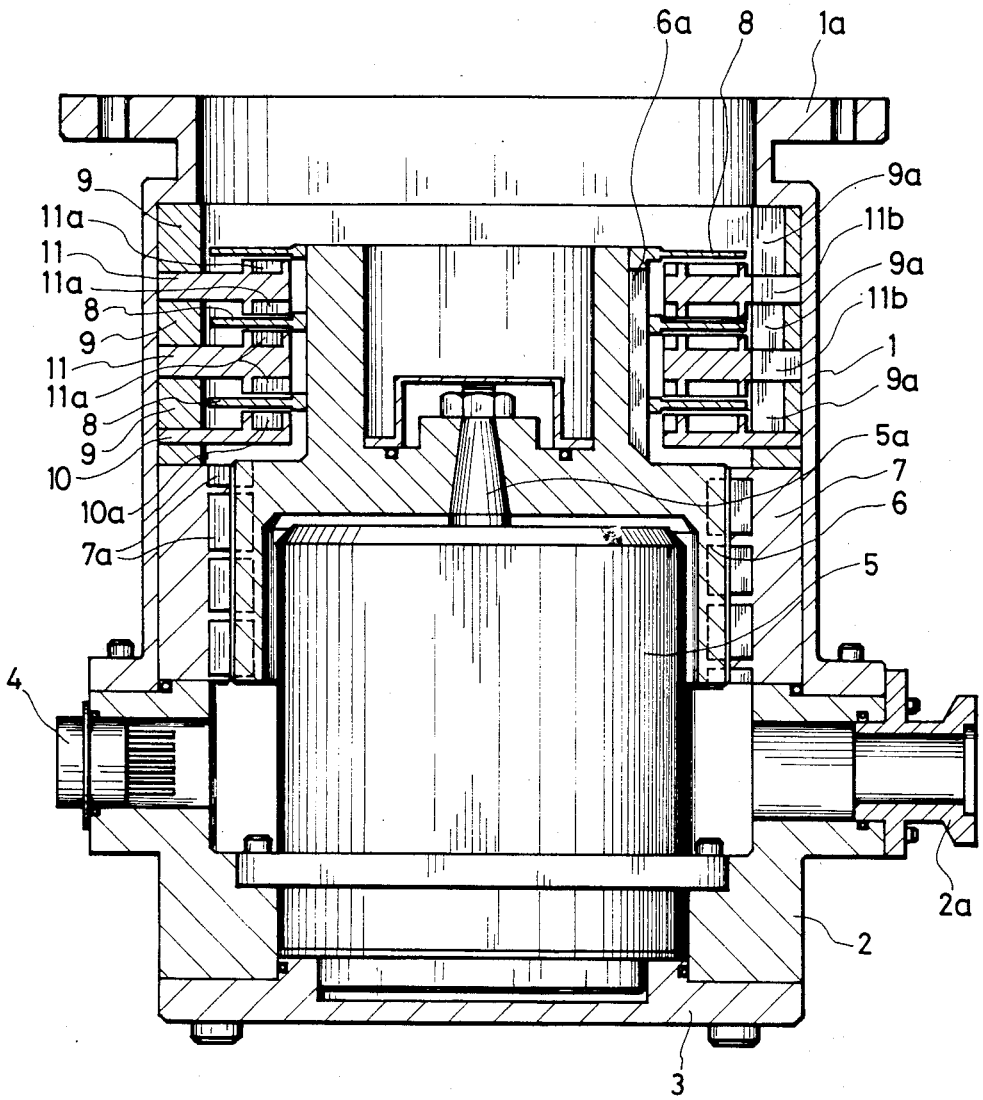
FIG. 2 is a longitudinal cross-sectional view of a turbo-molecular pump according to the present invention.
Figure 3:
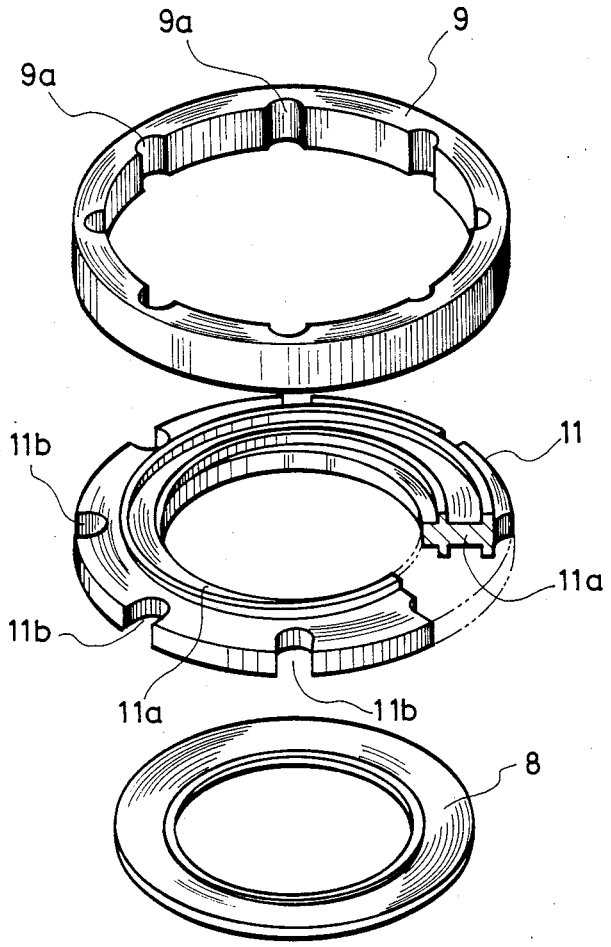
FIG. 3 is a perspective view of a portion of the pump of FIG. 2 in a disassembled state.

FIG. 2 is a whole view of a combined turbo-molecular pump according to the invention and FIG. 3 is an exploded view of a part thereof. The pump is composed of a cylindrical housing 1, a base 2 which is airtightly secured to the bottom portion of the housing 1 and a cover 3 which covers the under opening of the base 2.

The upper portion of the housing 1 is opened and on the peripheral portion thereof, a flange portion 1*a* is embodied and during use, the flange portion 1*a* is connected to the outlet hole of vacuum chamber and the like (not shown). On a part of the base 2, a connector 4 is arranged and on an opposite part thereof, an outlet pipe 2*a* is secured. The outlet pipe 2*a* is connected to a rotary pump or a mechanical booster. Moreover, a rotor case 5 is arranged within the base 2 and to a rotor shaft 5*a*, which is extruded on upper portion thereof, a rotor 6 is fixed by thread.

In the rotor case 5 are housed a driving motor to be connected to a connector 4 and a control device. At the inner periphery of the housing 1 is provided a cylinder 7 having a helical or thread groove 7*a* formed in the inner periphery thereof in the region spaced from the lower exterior periphery of the rotor 6. On the upper portion of the rotor 6, are fixed rotary circular plates 8 arranged in three axially spaced steps, and three stationary circular plates 10, 11, 11 are secured via spacer rings 9 on the interior periphery of the housing 1 so as to face the rotary circular plates 8.

Of the stationary circular plates, the lowermost plate 10 is provided with a spiral groove 10*a* only on the upper surface thereof, and the upper stationary circular plates 11 are provided with a spiral groove 11*a* on both the upper and lower surfaces thereof. The winding direction of each spiral groove 10*a*, 11*a* is the same in both the upper and lower surfaces. Further, on the circumference of each stationary circular plate, a plurality of openings or notch grooves 11*b* are provided and on the interior periphery of the spacer ring 9, openings or notch grooves 9*a* are also provided. The grooves 11*b* and 9*a* are axially aligned to form a plurality of axial flow passages for flowing the gas downwardly and into the spiral grooves 10*a*, 11*a* so that the upper opening of the housing 1 can communicate with the exterior periphery of the rotor 6. In turn, on the external surface of the rotor 6, a plurality of knurled axial passage grooves 6*a* are provided. Each passage groove 6*a* is closed by the uppermost rotary circular plate 8 and at the lower portion thereof communicates with the helical or thread groove 7*a*. By such a construction, when the rotor 6 of the turbo-molecular pump is rotated, gas supplied from the inlet port is supplied through the passage grooves 9*a*, 11*b* and in accordance with rotation of the rotary plates 8, the gas flows along the spiral grooves 10*a*, 11*a* so as to undergo compression and is supplied to the helical or thread groove 7*a* of the cylinder 7 through the axial passage grooves 6*a* which are provided along the circumference of the rotor 6. In accordance with the rotation of the rotor 6, the gas is further compressed along the helical or thread groove 7*a* and is exhausted from the outlet pipe 2*a* to the open air.

Figure 1:
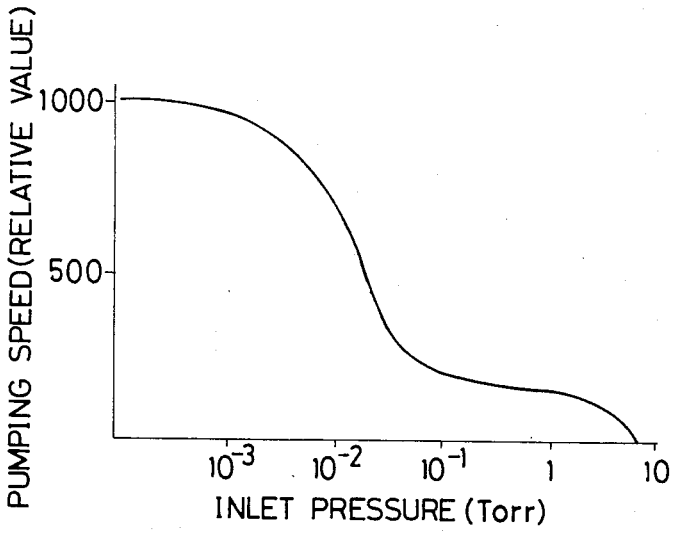
FIG. 1 is a graph of the pumping speed-inlet pressure characteristic of a conventional combined turbo-molecular pump.
Figure 4:
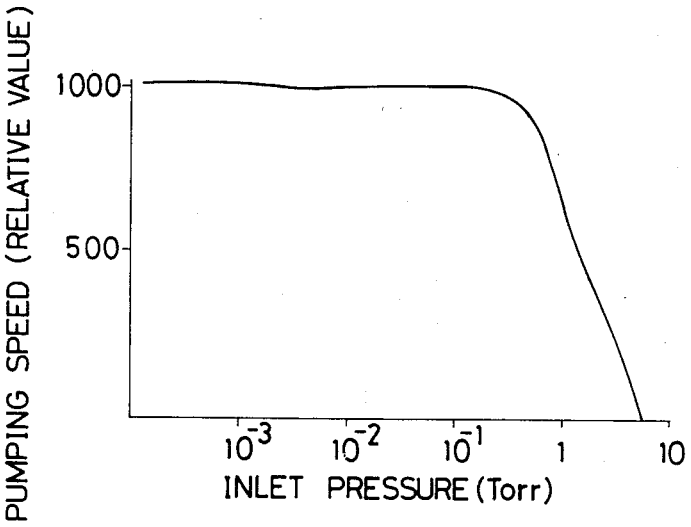
FIG. 4 is a graph of the pumping speed-inlet pressure characteristic turbo-molecular pump according to the present invention.

The gas which is compressed through each spiral groove 11*a* and 10*a* on the upper portion of the rotor 6 is supplied within the helical or thread groove 7*a* so that the pumping speed can be increased even if the throughput from the thread groove 7*a* is less. FIG. 4 illustrates an observed value of the pumping speed in reference to the inlet port pressure of a turbo-molecular pump which is constituted as above-mentioned. This figure shows that in a range of $10^{-2}$ to 1 Torr, the pumping speed is not at all changed and a stable pumping speed can be maintained in this range in comparison with a conventional combined type of turbo-molecular pump and a thread-groove pump or a spiral pump.

Moreover, in the afore-described embodiment, the spiral grooves are provided on the stationary circular plates, but if it is desired, the spiral grooves can be provided on the rotary circular plates and, the effect can be obtained. Further, it is also possible to form the helical or thread groove in the rotor instead of the cylinder.

As shown in FIG. 4, according to the present invention, in a range in which the prior art turbo-molecular pump efficiency is lowered and a rotary pump can not be effectively driven, a stable driving can be executed.

Therefore, a combined turbo-molecular pump according to this invention is suitable for a semiconductor fabricating device to execute fabricating steps, such as flowing a gas current of plasma CVD, reactive ion-etching material and so on.

What is claimed:

1. A combined turbo-molecular pump of the type having rotary circular plates at the inlet port of a rotatable rotor and stationary circular plates being alternatively arranged in layers at the circumference thereof and a thread-groove disposed either on the rotor or the cylindrical part which surrounds the rotor in the vicinity of the circumference of the outlet side of the rotor, the improvement in that on both surfaces of either said rotary circular plate or said stationary circular plate, there is provided respectively a spiral groove having the same winding direction, and the circumference of each stationary circular plate communicates through parallel axial passages with the inlet port and each rotary circular plate communicates with said thread-groove on its center side.

2. A combined turbo-molecular pump according to claim 1; wherein the stationary circular plates have axial notches formed around the outer circumference thereof in circumferentially shaped relation, the axial notches of each stationary circular plate being axially aligned with axial notches in the other stationary circular plates to define axial passages opening at the inlet port.

3. A combined turbo-molecular pump according to claim 2; wherein the rotor has a plurality of axial grooves which are closed at their upper ends and which are open at their lower ends, the open lower ends being in communication with the thread-groove.

4. A combined turbo-molecular pump according to claim 1; wherein the rotor has a plurality of axial grooves which are closed at their upper ends and which are open at their lower ends, the open lower ends being in communication with the thread-groove.

5. A turbo-molecular pump for pumping gas comprising: a housing having a gas inlet at one axial end thereof and a gas outlet in the vicinity of the other axial end thereof; a rotor mounted to undergo rotation within the housing; drive means for rotationally driving the rotor; a plurality of radially extending rotary plates connected to the rotor to rotate therewith, the rotary plates being connected in axially spaced relation along the inlet side of the rotor; a plurality of radially extending stationary plates stationarily disposed within the housing, the stationary plates being disposed in axially spaced relation such that the rotary and stationary plates are alternately disposed with respect to one another in the axial direction; means defining spiral flow grooves in either the rotary or stationary plates, the spiral flow grooves all having the same winding direction which effects inward flow of gas toward the rotor; means defining axial flow passages extending axially through the stationary plates for flowing gas from the gas inlet to the radial outward ends of the spiral flow grooves; means defining axial flow passages extending along the rotor for flowing gas from the radial inward ends of the spiral flow grooves toward the gas outlet; and means defining a helical flow groove for flowing gas from the downstream ends of the rotor axial flow passages to the gas outlet.

6. A turbo-molecular pump according to claim 5; wherein the means defining axial flow passages extending axially through the stationary plates comprises a plurality of openings circumferentially spaced from one another around each stationary plate, the openings of each stationary plate being axially aligned with the openings of the other stationary plates to define the axial flow passages.

7. A turbo-molecular pump according to claim 6; wherein the axial flow passages which extend axially through the stationary plates are parallel to one another.

8. A turbo-molecular pump according to claim 6; wherein the openings around each stationary plate comprise notches formed around the outer circumference of the stationary plate in circumferentially spaced relation.

9. A turbo-molecular pump according to claim 8; including a ring-shaped spacer interposed between each two adjoining stationary plates, each ring-shaped spacer having notches formed around the inner circumference thereof, the spacer notches being axially aligned with the stationary plate notches to define therewith the axial flow passages.

10. A turbo-molecular pump according to claim 5; wherein the means defining a helical flow groove comprises means disposed within the housing for defining a stationary helical flow groove, and wherein the rotor has a cylindrical surface portion which confronts and effectively overlies the helical flow groove.

11. A turbo-molecular pump according to claim 10; wherein the means defining axial flow passages extending axially through the stationary plates comprises a plurality of openings circumferentially spaced from one another around each stationary plate, the openings of each stationary plate being axially aligned with the openings of the other stationary plates to define the axial flow passages.

12. A turbo-molecular pump according to claim 5; wherein the means defining a helical flow groove comprises means defining a rotary helical flow groove in the rotor.

13. A turbo-molecular pump according to claim 12; wherein the means defining axial flow passages extending axially through the stationary plates comprises a plurality of openings circumferentially spaced from one another around each stationary plate, the openings of each stationary plate being axially aligned with the openings of the other stationary plates to define the axial flow passages.

* * * * *